United States Patent [19]

Holbrook

[11] Patent Number: 4,700,921

[45] Date of Patent: Oct. 20, 1987

[54] ADJUSTABLE PEDESTAL FOR BOAT SEATS

[76] Inventor: James H. Holbrook, 2410 S. Madison, Raymore, Mo. 64083

[21] Appl. No.: 835,625

[22] Filed: Mar. 3, 1986

[51] Int. Cl.[4] ..... F16M 13/00; B63B 29/04

[52] U.S. Cl. ..... 248/421; 248/188.6; 297/252; 297/345

[58] Field of Search ..... 248/421, 423, 188.6; 297/252, 345

[56] References Cited

U.S. PATENT DOCUMENTS

| | | | |
|---|---|---|---|
| 2,689,601 | 9/1954 | Fredenburgh | 297/252 |
| 2,993,675 | 7/1961 | Tatter | 297/252 X |
| 3,022,037 | 2/1962 | Stallard | 248/421 |
| 3,821,825 | 7/1974 | Bailey | 297/252 X |
| 4,025,107 | 5/1977 | Chippa | 248/421 X |
| 4,032,103 | 6/1977 | Ehrichs | 248/421 |
| 4,296,694 | 10/1981 | Kobayashi | 248/421 X |
| 4,312,491 | 1/1982 | Aondetto | 248/421 X |
| 4,432,525 | 2/1984 | Duvall | 297/252 X |
| 4,566,667 | 1/1986 | Yanagisawa | 248/421 X |

*Primary Examiner*—Cornelius J. Husar
*Assistant Examiner*—Todd G. Williams
*Attorney, Agent, or Firm*—Kokjer, Kircher, Bradley, Wharton, Bowman & Johnson

[57] ABSTRACT

An adjustable pedestal for mounting an added seat in a fishing boat in a manner to allow the elevation of the seat to be adjusted. A flanged base plate is secured in the boat and connected by a scissors arm arrangement with a platform to which the added seat is mounted. The scissors arm arrangement allows the platform to be raised and lowered while at all times remaining horizontal. The platform is also restricted to only vertical movement to prevent the added seat from moving side to side. A releaseable pivot bracket locks the platform rigidly in place at a plurality of discrete elevations.

5 Claims, 5 Drawing Figures

ADJUSTABLE PEDESTAL FOR BOAT SEATS

BACKGROUND AND SUMMARY OF THE INVENTION

This invention relates generally to the mounting of seats in fishing boats and more particularly to an adjustable pedestal which mounts a boat seat in a manner allowing its elevation to be selectively adjusted.

The permanent seats that are normally built into small fishing boats are typically backless seats located well down in the boat. The lack of a back rest makes the built-in boat seat somewhat uncomfortable for many persons. Moreover, the seat is generally too low to be conveniently used during many types of fishing activities.

Consequently, some fishermen have added more comfortable and functional seats to their fishing boats. The added seat usually includes a back rest and is often mounted on top of a pedestal which is in turn secured on the built-in boat seat. The fisherman can then fish from the added seat at a more desirable elevated position and can take advantage of the convenience offered by the back rest. However, the elevated position of the added seat places its occupant in an unstable position and can create unsafe conditions at times, particularly when the boat is travelling at a high rate of speed.

It is thus evident that a need exists for an improved arrangement for mounting a boat seat at a convenient height for fishing while permitting it to be safely occupied during movement of the boat. It is the principal goal of the present invention to meet that need.

More specifically, it is an important object of the invention to provide an adjustable mounting pedestal for a boat seat which permits selective adjustment of the elevation of the seat. During fishing activity, the pedestal can be extended to one of its raised positions to locate the seat at a more convenient elevation for fishing.

Another and related object of the invention is to provide an adjustable pedestal which can be collapsed to lay flat on the built-in boat seat. This lowers the occupant of the seat to a stable position within the boat during high speed operation.

Still another important object of the invention is to provide an adjustable pedestal which can be adjusted among a number of different elevations in order to accommodate different individual preferences.

A further object of the invention is to provide an adjustable pedestal which exhibits sufficient strength to withstand all loads to which it is subjected in normal use. In this regard, the scissors arm arrangement included in the pedestal is important because it provides the structural advantages and rigidity of triangular shapes. The rigid panel which forms part of the scissors arm mechanism is also important in that it adds to the strength and stability of the pedestal.

Yet another object of the invention is to provide an adjustable pedestal which can be rigidly locked in place at any of its positions and yet can be quickly and easily adjusted when it is desired to vary the elevation of the boat seat.

An additional object of the invention is to provide an adjustable pedestal of the character described which can be quickly and easily installed in fishing boats of various types.

A still further object of the invention is to provide an adjustable pedestal of the character described which is constructed simply and economically and in a manner to mount different types of added boat seats and other structures.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
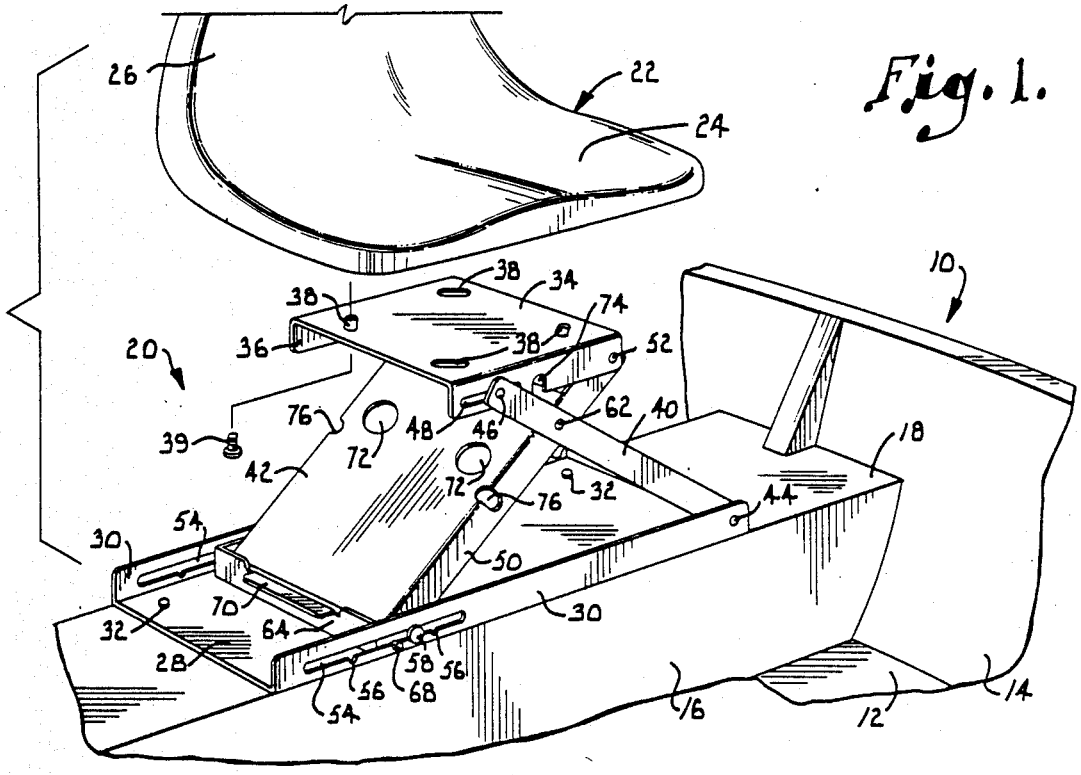
FIG. 1 is a fragmentary perspective view showing a small fishing boat equipped with an adjustable pedestal constructed according to a preferred embodiment of the present invention, with the pedestal in a partially raised position and the added boat seat shown in an exploded position relative to the pedestal.

Referring now to the drawings in more detail and initially to FIG. 1, a typical small fishing boat is shown fragmentarily and is generally identified by reference numeral 10. The fishing boat 10 includes a horizontal deck 12 and a pair of opposite sides 14 (one of which is shown in FIG. 1). A rectangular, box-like permanent seat 16 is built into the boat 10 and extends across the deck 12 between the opposite sides 14. The built-in seat 16 has a horizontal seating surface 18 located well below the upper edges of the sides 14.

In accordance with the present invention, an adjustable pedestal 20 serves to mount an added seat 22 in the boat 10. Seat 22 may be any desired type of seat and is shown for purposes of illustration as an individual "bucket" type seat having a contoured seating surface 24 and a back rest 26.

The adjustable pedestal 20 includes a base formed by a flat base plate 28 having upturned flanges 30 on its opposite sides edges. Plate 28 preferably has substantially the same width as the seating surface 18 of the built-in seat and a length somewhat less than the seating surface 18. A plurality of screws 32 or other fasteners are used to securely fasten the base plate 28 on top of the seating surface 18.

Also included in the adjustable pedestal 20 is a rectangular platform 34 having a planar upper surface to which the added seat 22 is secured. The platform 34 has substantially the same width as the base plate 28 and is provided on its opposite side edges with downturned flanges 36. Four slots 38 are formed in the platform 34 to receive bolts 39 (FIG. 1) or other fasteners which are extended upwardly through the slots and threaded into the bottom of the added seat 22 in order to secure it rigidly in place on top of platform 34. The elongated configuration of each slot 38 provides for adjustment of the position of the seat 22 on platform 39.

The platform 34 is connected with the base plate 28 by a scissors arm arrangement which includes a pair of parallel pilot arms 40 and a rigid panel 42. The lower ends of arms 40 are pivotally connected with the flanges 30 by horizontal pivot couplings 44 which are aligned with one another to form a common horizontal pivot axis about which arms 40 can pivot relative to the base of the pedestal. The upper ends of arms 40 are provided with inwardly projecting guide pins 46 which extend through horizontal slots 48 formed in flanges 36. Slots 48 are aligned with one another, and each slot extends less than half the length of its flange 36. The guide pins 46 fit closely in slots 48 and are able to move in the slots between their opposite ends. The fit of the guide pins in the slots connects the upper end of each arm 40 with the platform 34 in a manner permitting the upper end of the arm to move linearly relative to the platform along the path defined by the slot. Arms 40 are also able to pivot relative to platform 34 about the horizontal axis provided by the aligned pins 46.

The panel 42 is a flat plate member having downturned flanges 50 on its opposite sides. The flanges 50 are located inside of and adjacent to the flanges 30 and 36 of the base plate and platform. Flanges 50 also extend upwardly beyond the edge of panel 42. The upper end of panel 42 is pivotally connected with platform 34 by a pair of horizontal pivot couplings 52 which are axially aligned to provide a horizontal pivot axis about which panel 42 can pivot relative to platform 34. The pivot coupling 52 on each flange 36 is directly in line with the slot 48 that is formed through the flange.

Each flange 30 on the base plate 28 is provided with a horizontal slot 54 which extends considerably less than half the length of the flange. The pivot coupling 44 on each flange 30 is directly in line with the slot 54. A plurality of small notches 56 are formed through each flange 30 at locations adjacent the lower edges of slots 54. The notches 56 are spaced apart from one another and are shown as being three in number for each slot 54, although other numbers are possible. The notches 56 on opposite sides of the base plate are aligned with one another, as are the two slots 54.

Figure 4:
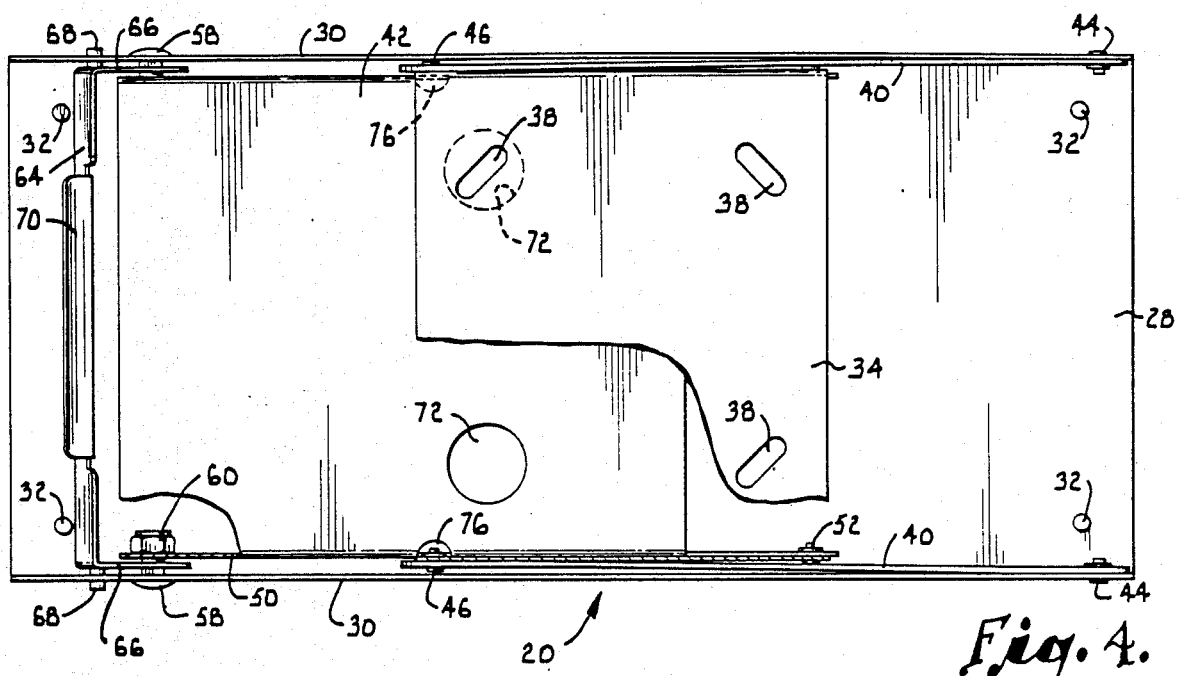
FIG. 4 is a fragmentary top plan view taken generally along line 4—4 of FIG. 3 in the direction of the arrows, with portions broken away for purposes of illustration.

A bolt 58 extends through each slot 54 and through the lower end of each flange 50 on panel 42. A lock nut 60 (see FIG. 4) is secured to the free end of each bolt 58 at a location inside of flange 50. The shanks of the bolts 58 fit closely in the slots 54 and serve as guide elements which connect the lower end of panel 48 with the base plate 28 for linear movement along the horizontal path provided by the slots 54.

Each pivot arm 40 is pivotally connected with the adjacent flange 50 by a pivot coupling 62. The pivot couplings are located intermediate the ends of the arms 40 and flanges 50 and somewhat closer to the upper ends of the arms and flanges than to the lower ends. The couplings 62 are axially aligned in order to provide a common horizontal pivot axis about which arms 40 and panel 42 can pivot relative to one another.

Figure 2:
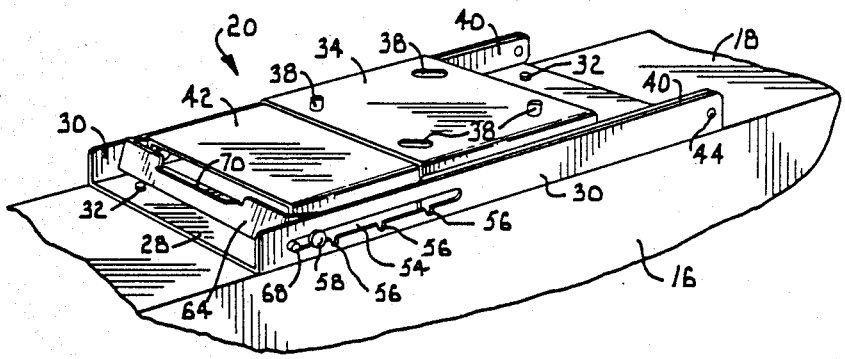
FIG. 2 is a fragmentary perspective view similar to FIG. 1, but showing the pedestal collapsed to its fully lowered position.
Figure 5:
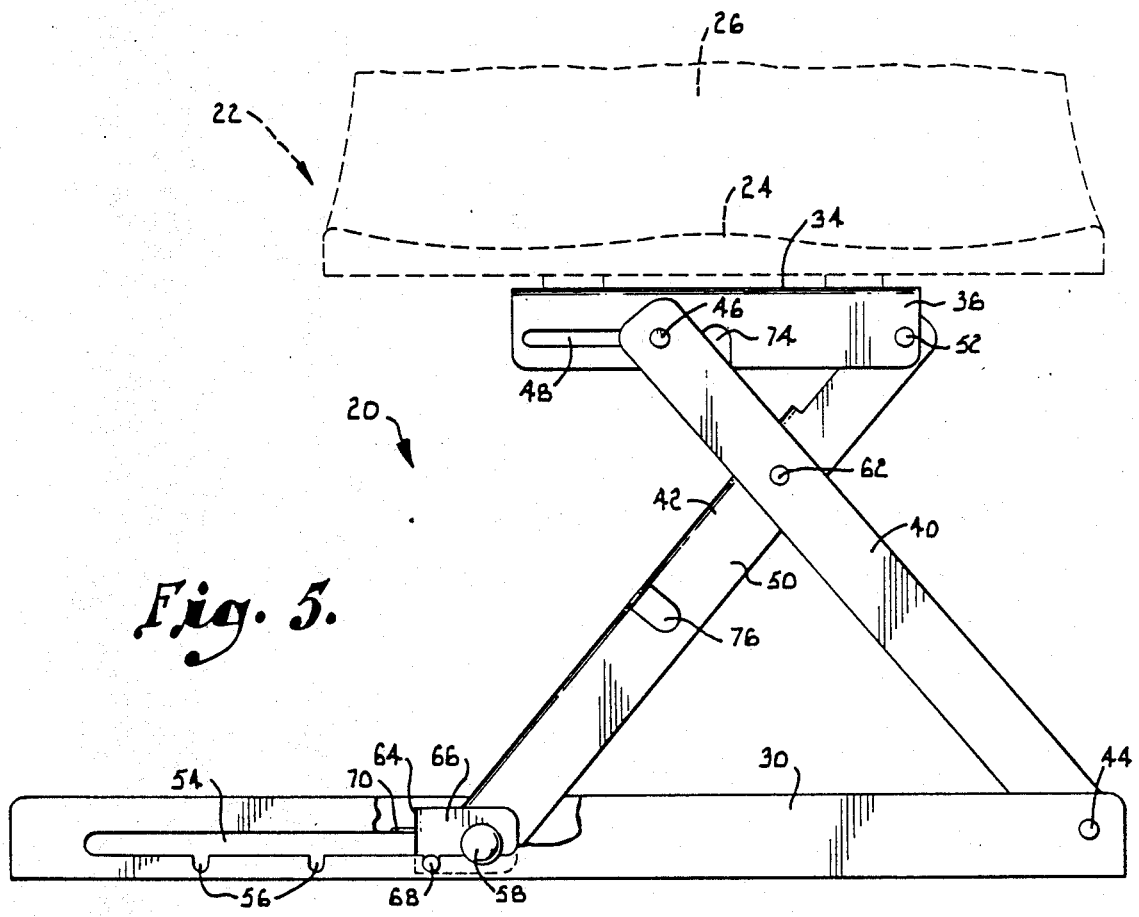
FIG. 5 is a front elevational view showing the pedestal in its fully raised position, with the added boat seat shown fragmentarily in broken lines and a portion of the pedestal broken away for purposes of illustration.

By virtue of the scissors arm arrangement formed by the pivot arms 40 and panel 42, platform 34 can be raised and lowered between the fully raised position shown in FIG. 5 and the fully lowered or collapsed position shown in FIG. 2. In the collapsed position of the platform, the guide bolts 58 are moved to locations near the left ends of slots 54 (as viewed in FIG. 2). This movement of the lower end of panel 42 causes its upper end to drop straight down toward the base plate 28. At the same time, arms 40 pivot downwardly about the pivot couplings 44, and the guide pins 46 move downwardly and to the left in slots 48. When the pedestal is in its fully collapsed position, panel 42 has a horizontal orientation and is substantially coplanar with the platform 34 which rests on top of it. Arms 40 are located side-by-side with and parallel to flanges 30, 50 and 36. Arms 40 and panel 42 are parallel to one another in the collapsed position.

The scissors arm mechanism maintains the upper surface of platform 34 horizontal in all positions, including the fully raised and fully lowered positions and all positions in between. Consequently, the added seat 22 is at all times maintained in the proper orientation. It is also noteworthy that the scissors arm mechanism causes the platform 34 to move only straight upwardly and straight downwardly with no side-to-side movement. As a result, the added seat 22 is in the same position relative to the width of the boat at all times (preferably, centered across the boat).

Figure 3:
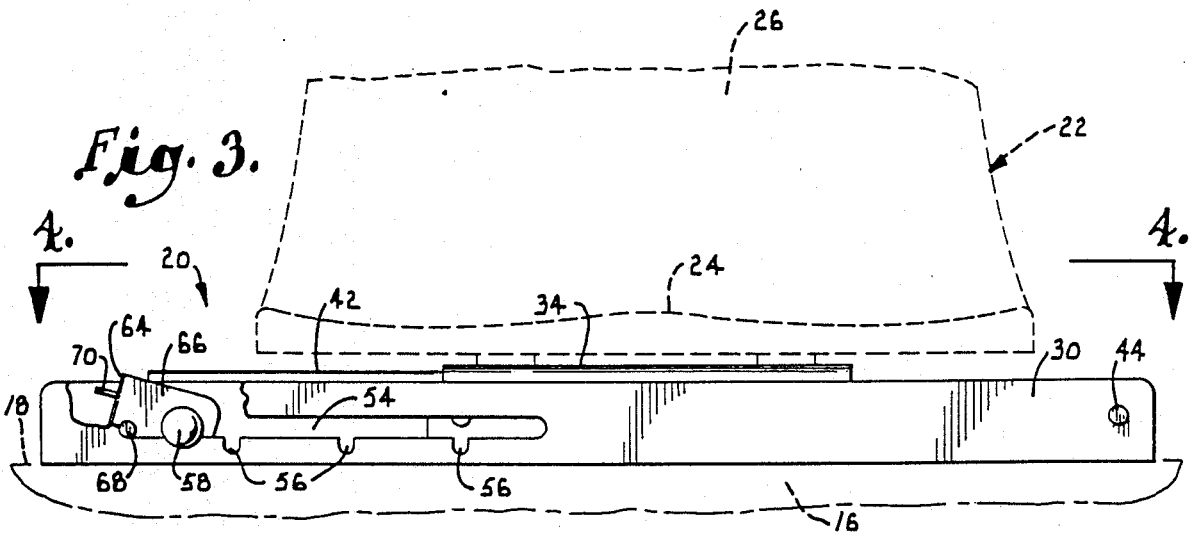
FIG. 3 is a front elevational view showing the pedestal collapsed to its lowered position, with the built-in boat seat and the added boat seat shown fragmentarily in broken lines and with a portion of the pedestal broken away for purposes of illustration.

A pivot bracket 64 acts to releasably lock the scissors mechanism in order to lock platform 34 in position. The pivot bracket 64 extends across the lower end of panel 42 and is provided with flanged opposite ends 66 which are pivoted on the guide bolts 58. Bracket 64 is thus carried on panel 42 and is pivotal about the horizontal axis provided by the aligned guide bolts 58. Each of the flanged ends 66 has an outwardly projecting locking pin 68 which extends loosely through the adjacent slot 54. The pins 68 have horizontal orientations and are axially aligned with one another. Each pin 68 has a size to closely fit in the notches 56. A tab 70 projects from bracket 64 and provides a finger grip which facilitates pivoting of bracket 64 between the locking position shown in FIG. 5 and the release position shown in FIG. 3. In the locking position of the bracket, pins 68 are seated in one set of the notches 56, and the locking pins then lock the lower end of panel 42 against movement in the slots 54. In the release position of bracket 64, pins 68 are raised out of notches 56 and are engaged against the upper edges of slots 64 in order to prevent further upward pivoting of the bracket 64. Then, bracket 64 is released and can move along slots 54.

The main body of panel 42 is provided with a pair of circular cutouts 72 which are aligned with slots 38 in the fully lowered position of platform 34. The cutouts 72 are thus located to receive the heads of the fasteners 39 that are used to connect the added seat 22 with platform 34. Similarly, each flange 36 is provided with a cutout 74 which receives the head of pivot coupling 62 in the fully lowered or collapsed position of the pedestal. Additional cutouts 76 are formed in flanges 50 at locations to receive the heads of the pin elements 46 when the pedestal is in its fully lowered position.

The pedestal 20 can be quickly and easily installed in the boat 10 by applying the screws 32 or other fasteners which attach the base plate 28 with the seating surface 18. Seat 22 or another type of seat can be secured to platform 34 by inserting fasteners 39 through the slots 38 and into the seat.

In use, the pedestal 20 is preferably collapsed to the fully lowered position shown in FIG. 2 when the boat 10 is operated at a high rate of speed. In this condition, the pedestal 20 is collapsed and lies flatly on the seating surface 18 such that the added seat 22 is at substantially the same height as the built-in boat seat 16. Consequently, the occupant of the added seat 22 is seated at a stable position when the boat is in motion at high speeds.

To elevate the added seat 22 for fishing activity, pedestal 20 can be extended to any one of three elevated positions. To raise platform 34 to the first elevated position, the seat 22 or platform 34 can be lifted, and this moves the lower end of panel 42 to the right as viewed in the drawings. When bracket 64 has reached a position in which the pins 68 are aligned with the leftmost set of notches 56, tab 70 can be pushed downwardly to pivot bracket 64 until the pins 68 enter the notches 56. Then, the fit of the locking pins 68 in notches 56 locks the lower end of panel 42 against additional movement along slots 54 and thereby rigidly locks the platform 38 at the first elevated position. When loads are applied such as by persons sitting on the added seat 22, the force tends to retain the locking pins 68 in place in the notches 56 so that there is no tendency for the pedestal to collapse.

Platform 34 can be raised to the next higher position by grasping tab 70 and pivoting bracket 64 upwardly to withdraw pins 68 from the first set of notches 56. Bracket 64 is then in the release position, and platform 34 can be raised until pins 68 are aligned with the center set of notches 56. At this time, bracket 64 is pivoted downwardly to cause the locking pins 68 to enter the center set of notches 56, thereby rigidly locking the platform 34 at its next higher elevation. This is the position shown in FIG. 1.

The platform 34 can be moved to the fully raised position by pivoting bracket 64 at the release position, raising the platform, and then pivoting bracket 64 downwardly to cause pins 68 to enter the rightmost set of notches 56. This is the position shown in FIG. 5 and it is noted that the platform 34 may be elevated well above the upper edges of the boat sides 14.

The three discrete elevated positions of platform 34 are ordinarily sufficient to accommodate the individual preferences of the various occupants of the added seat 22. However, a fewer or greater number of elevated positions of the platform can be provided simply by providing additional sets of notches 56. Platform 34 can be moved among its various positions by pivoting bracket 64 to the release position and adjusting the elevation of the platform as desired before again pivoting the bracket to its locking position so platform 34 is progressively raised, arms 40 and panel 42 are increasingly inclined. In the fully lowered position of the platform, the locking pins 68 are not located in any of the notches 56 but are instead located at the left ends of the slots 54, since there is then no need to resist downward movement of the platform.

Preferably, the components of the pedestal 20 are constructed of steel or another sturdy and durable material. In addition, as best shown in FIG. 5, the scissors arm arrangement provided by the pivot arms 40 and panel 42 forms two rigid triangular structures on which platform 34 is supported. The rigidity and structural stability of the triangles enhances the strength of the pedestal and allows it to withstand all downward loads to which it is subjected in normal use. It is also pointed out that the rigid panel 42 is included to provide the scissors arm arrangement with more strength than would be provided by two pairs of parallel pivot arms.

Although pedestal 20 is particularly well suited for mounting an added boat seat in a fishing boat and has been shown and described as performing this function, it should be understood that the pedestal is equally capable of mounting other structures on other surfaces.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as be understood that all matter herein set forth or shown in the accompanying drawings is to be interpreted as illustrative and not in a limiting sense.

Having thus described the invention, I claim:

1. An adjustable pedestal for installation in a fishing boat to support a boat seat in the boat, said pedestal comprising:

a base adapted to be secured on a generally horizontal support surface in the boat;

a platform for receiving and supporting the boat seat, said platform having a generally planar surface on which the seat is carried and which faces away from the base;

a pair of substantially parallel pivot arms each having a lower end pivoted to said base and an upper end connected with said platform for linear movement thereon;

a rigid panel having an upper end pivoted to said platform at a location offset from the upper ends of said arms and a lower end connected with said base for linear movement thereon toward and away from the lower ends of said arms, said panel being pivoted to each of said arms at a location between the upper and lower ends thereof to mount the platform for movement between a raised position wherein the platform is elevated above the base and a lowered position wherein the platform is adjacent the base, said planar surface being maintained in a substantially horizontal orientation in the raised and lowered positions and in all positions therebetween and said platform being restricted to substantially vertical movement between the raised and lowered positions; and releaseable means for rigidly locking said platform in the raised position.

2. The pedestal of claim 1, including:

a pair of opposite sides of said base each having a flange presenting an elongate horizontal slot having upper and lower edges;

opposite sides of said panel each having a guide element projecting therefrom through the corresponding slot, said guide elements being movable along the lengths of said slots to connect the lower end of the panel with the base for linear movement along the slots;

a pair of opposite sides of said platform each having a flange presenting an elongate horizontal slot; and a guide pin on the upper end of each arm, said guide pins extending through the slots of the flanges of the platform and being movable along the lengths thereof to connect the upper ends of the arms with said platform for linear movement along the slots of the platform flanges;

3. The pedestal of claim 2, wherein said releaseable means comprises:

a pivot bracket carried on the lower end of said panel and pivotal thereon between a locking position and a release position, said bracket carrying a pair of locking pins which extend into the respective slots of the flanges of the base; and a plurality of notches in said lower edge of each slot of each flange of the base, one notch being located to closely receive the corresponding locking pin when said bracket is pivoted to the locking position with the platform in the raised position and other of the notches being located to closely receive the locking pins when the bracket is pivoted to the locking position with the platform in an intermediate position between the raised and lowered positions.

means for coupling the lower ends of said flanges with said base for linear sliding movement thereon toward and away from said first axis;

means for coupling the upper ends of said arms with said platform for linear sliding movement thereon toward and away from said second axis, said arms and panel thereby cooperating to mount said platform for movement between a raised position wherein the platform is elevated above the base and a lowered position wherein said platform is adjacent the base with said planar surface being maintained in a substantially horizontal orientation in all positions thereof; and releaseable means for rigidly locking said platform in the raised position.

4. An adjustable pedestal comprising:

a base adapted to be received on a supporting surface;

a platform having a substantially planar surface facing away from the base for receiving loads;

a pair of substantially parallel pivot arms each having upper and lower ends, said lower ends of the pivot arms being pivoted to said base for pivotal movement about a first substantially horizontal pivot axis;

a rigid panel having opposite sides presenting flanges thereon, each flange having upper and lower ends and said upper ends of the flanges being pivoted to the platform for pivotal movement relative thereto about a second substantially horizontal pivot axis;

means for pivotally coupling said flanges with said arms at locations between the upper and lower ends of the flanges and arms;

means for coupling the lower ends of said flanges with said base for linear sliding movement thereon toward and away from said first axis;

means for coupling the upper ends of said arms with said platform for linear sliding movement thereon toward and away from said second axis, said arms and panel thereby cooperating to mount said platform for movement between a raised position wherein the platform is elevated above the base and a lowered position wherein said platform is adjacent the base with said planar surface being maintained in a substantially horizontal orientation in all positions thereof; and releasable means for rigidly locking said platform in the raised position.

5. An adjustable pedestal comprising:

a base adapted to be received on a supporting surface, said base having a pair of opposing flanges, with each flange having an elongate horizontal slot, each slot having a plurality of spaced apart notches;

a platform having a substantially planar surface facing away from the base for receiving loads;

scissors arm means pivotally mounting said platform for movement toward and away from said base between a raised position and a lowered position while at all times maintaining said planar surface in a substantially horizontal orientation, said scissors arm means including a pair of guide elements extending through said slots in the respective flanges of the base and movable along the slots during movement of the platform between the raised and lowered positions; and a pivot bracket having opposite ends mounted for pivotal movement on and about the respective guide elements, said pivot bracket including a pair of pins on the respective opposite ends thereof with said pins extending into the respective slots and being offset from the guide elements to be received in and removed from said notches in response to pivotal movement of said brackets in opposite directions about the guide elements, said pins locking the platform against movement when received in the notches.

* * * * *